US006872116B1

(12) United States Patent
Dunnum et al.

(10) Patent No.: US 6,872,116 B1
(45) Date of Patent: Mar. 29, 2005

(54) MUSICAL BABY BOTTLE

(76) Inventors: Christopher Dunnum, 19600 NW. 5th Pl., Miami, FL (US) 33169; Michael M. Anthony, 10189 W. Sample Rd., Coral Springs, FL (US) 33065

( * ) Notice: Subject to any disclaimer, the term of this patent is extended or adjusted under 35 U.S.C. 154(b) by 0 days.

(21) Appl. No.: 10/801,787

(22) Filed: Mar. 16, 2004

(51) Int. Cl.[7] ..... A63H 3/00

(52) U.S. Cl. ..... 446/73; 446/267; 446/297; 446/304; 446/76; 215/396; 206/217

(58) Field of Search ..... 446/73, 76, 77, 446/267, 297, 304, 397, 71, 74, 81, 175; 206/217, 542, 216, 459.1; 215/6, 396, 395, 11.2; 40/329, 453

(56) References Cited

U.S. PATENT DOCUMENTS 3,512,301 A * 5/1970 Kramer ..... 446/71
3,990,596 A * 11/1976 Hoftman ..... 215/11.1
4,943,017 A * 7/1990 Ennis ..... 248/102
5,125,866 A * 6/1992 Arad et al. ..... 446/397
6,037,872 A * 3/2000 Dunnum ..... 340/586
6,264,049 B1 * 7/2001 Shteynberg ..... 215/11.2

* cited by examiner

*Primary Examiner*—Bena B. Miller
(74) *Attorney, Agent, or Firm*—Mark D. Bowen, Esq.; Stearns Weaver Miller Weissler Alhadeff & Sitterson, P.A.

(57) ABSTRACT

An improved baby bottle adapted with handles and a sound-generating module for generating audible sounds. A generally cylindrical baby bottle is adapted with longitudinally extending slots on opposing sides of the bottle. The slots receive and retain a removable handle assembly having first and second opposing handles that facilitate holding of the bottle while feeding. Additionally, the handle assembly includes a portion adapted for receiving an interchangeable sound-generating module in removable engagement therewith. The sound-generating module includes a battery power source, memory chip, speaker, and electrical circuitry required to selectively produce sounds when disposed on the handle assembly. The sound module may be adapted to play single or multiple songs such as the ABC song or lullabies, or may be configured for educational purposes such as number counting lessons. The sound modules are interchangeable and the production of multiple sound modules provides the user with a variety of sounds to choose from. The baby bottle is provided with an enlarged base for stability.

7 Claims, 14 Drawing Sheets

MUSICAL BABY BOTTLE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure, as it appears in the Patent and Trademark Office patent file or records, but otherwise reserves all copyrights.

BACKGROUND OF THE INVENTION

1. Field of the Invention

The present invention relates to a baby bottle, and more particularly, to a baby bottle and attachable handles adapted with an electronic sound generating module capable of generating audible sounds including music, stories, or other pleasant soothing sounds.

2. Description of the Background Art

The use of infant bottles for feeding infants and children is well known. It is further known to adapt infant feeding bottles with one or more handles to assist the infant and/or parent in handling the bottle.

The present inventor has contributed to advancements in the art in the development of a baby bottle having removable handles and an automated sound producing means as disclosed in U.S. Pat. No. 6,037,872 (the "'872 patent") the disclosure of which is hereby incorporated herein by reference. The '872 patent discloses a baby bottle that includes one or more removable handles with integral voice chips received therein. The integral voice chips are electrically actuated by a mechanical thermostat received within a portion of the handle that is grasped by a user. Upon the thermostat sensing a predetermined temperature, a pair of timer circuits in communication therewith activate the voice chip. When the thermostat detects a temperature below the predetermined value, the timer circuits disable the voice chip after a predetermined duration. Accordingly, when a baby or other user grasps the handle, music or other sound recordings will be automatically emitted. When the baby releases the handle, the voice chip will be deactivated within a predetermined duration thereafter.

While the musical baby bottle disclosed in the '872 patent is considered acceptable for its intended purpose, the present inventor believes there are a number of limitations with the musical baby bottle disclosed in the '872 patent that can be overcome. More particularly, the attachment of handles on the bottle as disclosed in the '872 patent may render the bottle unstable and prone to tipping when placed on a supporting surface such as a table. In addition, it is considered desirable to provide a musical bottle wherein a variety of sounds may be generated.

BRIEF SUMMARY OF THE INVENTION

The present invention provides an improved baby bottle adapted with handles and a sound generating module for generating audible sounds. In a preferred embodiment, a generally cylindrical baby bottle is adapted with longitudinally extending slots on opposing sides of the bottle. The slots receive and retain a removable handle assembly having first and second opposing handles that facilitate holding of the bottle while feeding. Additionally, the handle assembly includes a portion adapted for receiving an interchangeable sound-generating module in removable engagement therewith. The sound-generating module includes a battery power source, memory chip, speaker, and electrical circuitry required to selectively produce sounds when disposed on the handle assembly. The sound module may be adapted to play single or multiple songs such as the ABC song or lullabies, or may be configured for educational purposes such as number counting lessons. The sound modules are interchangeable and the production of multiple sound modules provides the user with a variety of sounds to choose from. The baby bottle is provided with a radially enlarged base for stability.

Accordingly, it is an object of the present invention to provide an improved baby bottle.

Another object of the present invention is to provide an improved baby bottle having attachable handles.

Still another object of the present invention is to provide a musical baby bottle having an interchangeable sound module.

Still these and other objects will become apparent with reference to the detailed description below and the accompanying drawings.

DETAILED DESCRIPTION OF THE INVENTION

Figure 1:
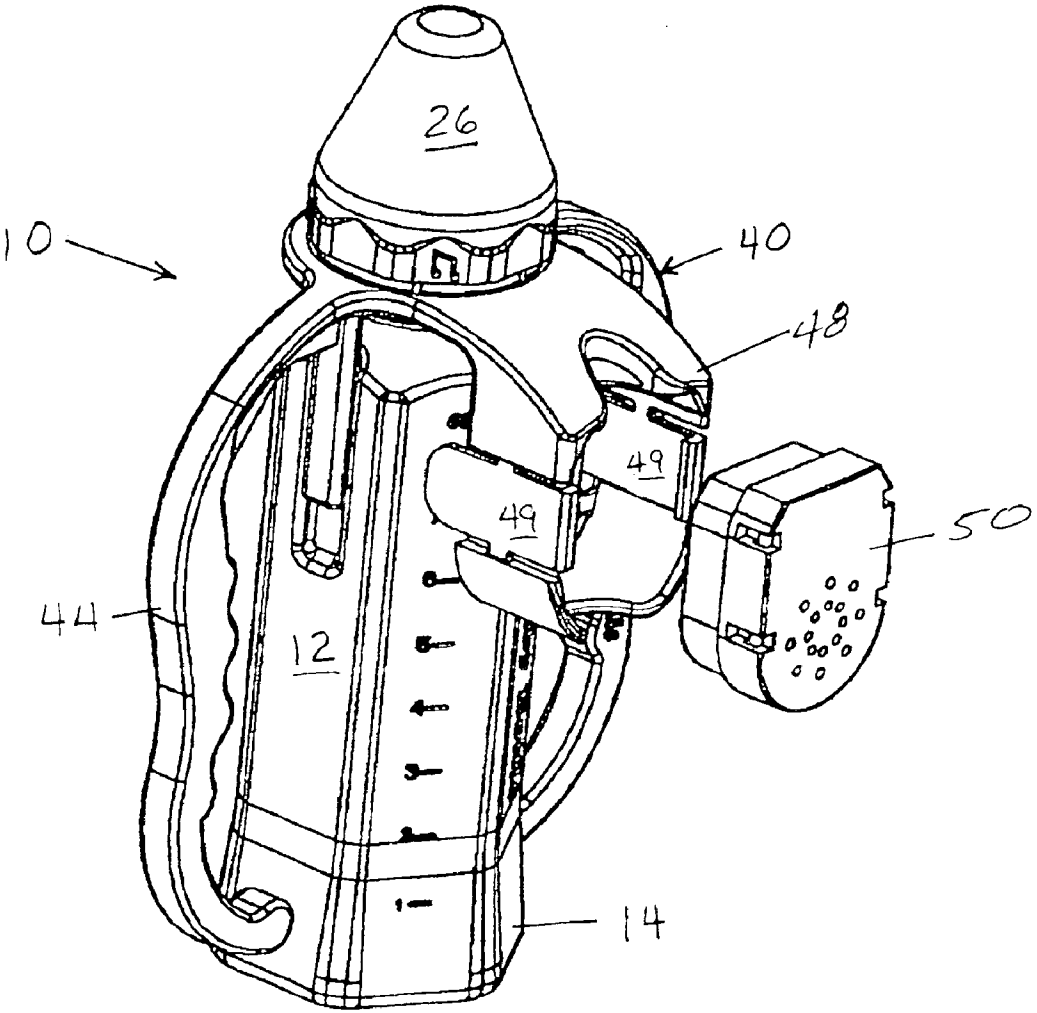
FIG. 1 is a perspective view of a sound generating baby bottle according to the present invention.

With reference now to the drawings, there is depicted an improved baby bottle, referenced as 10, according to a preferred embodiment of the present invention. Baby bottle 10 includes a hollow container 12 having a closed bottom end 14 and a top end 16 defining an opening. Bottom end 14 is preferably radially enlarged to provide a widened base for stability. Top end 16 includes a radially projecting lip 18 and a threaded neck portion 20. A rubber nipple 22 is secured to top end 16 by theaded engagement of a retaining member 24. A cap 26 may be disposed in covering relation with nipple 22 and retaining member 24.

Figure 2:
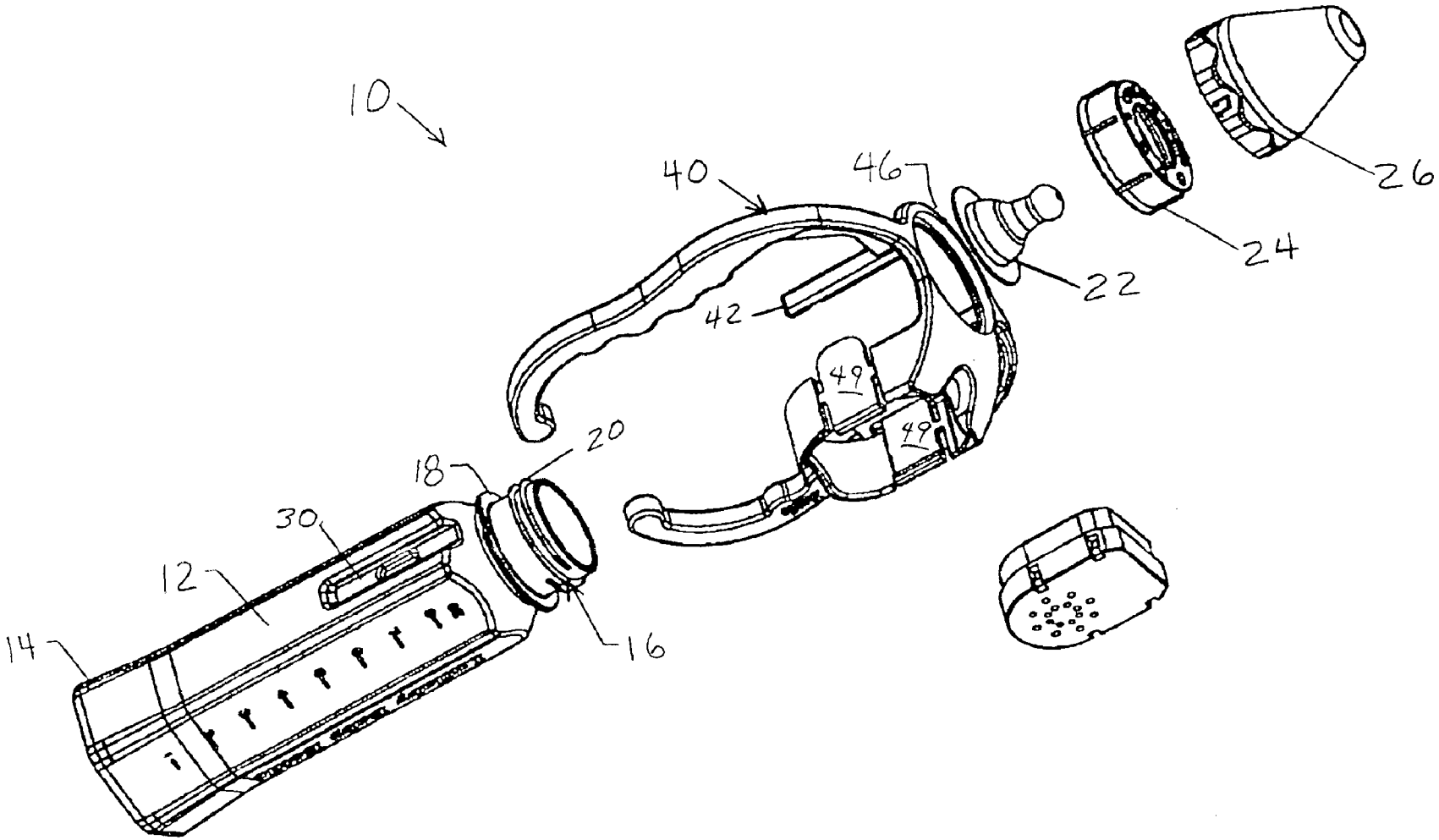
FIG. 2 is an exploded perspective view thereof.
Figure 3:
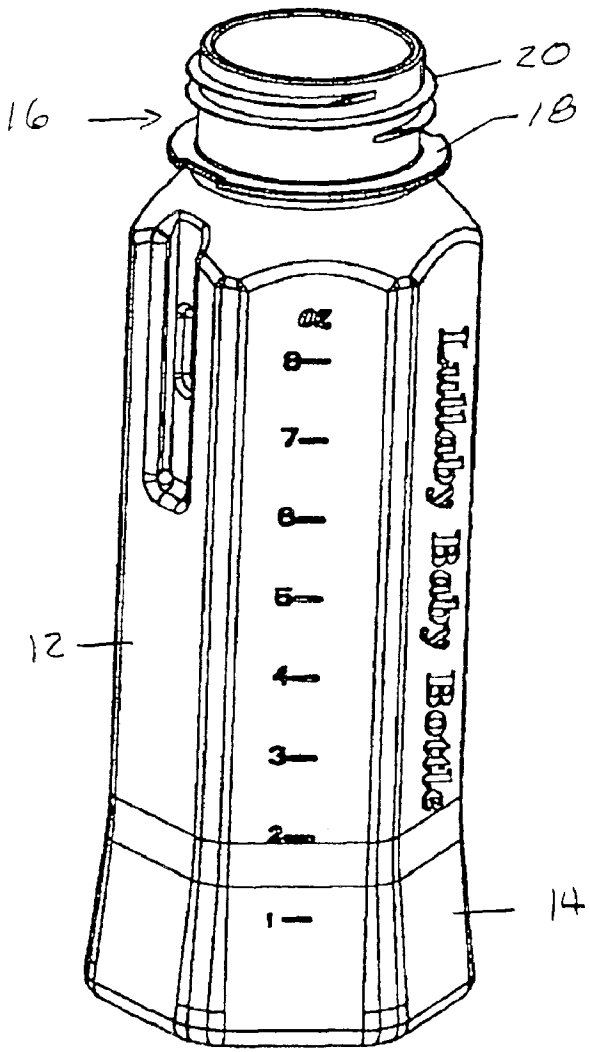
FIG. 3 is a perspective view of the main bottle body.

The outer surface of container 12 defines a pair of opposing recessed elongate slots, referenced as 30, for use in securing a handle assembly 40. More particularly, slots 30 each receive a mounting bracket 42 on handle assembly 40 in sliding/locking engagement. Handle assembly 40 further includes left and right handle grips 44 having ergonomic arcuate surfaces to facilitate easy grasping and holding by an infant. Handle assembly 40 further includes a top portion 46 defining an annular opening sized for mating engagement with container neck 20. As best illustrated in FIG. 2, handle assembly 40 is attached to container 12 by sliding the handle assembly mounting brackets 42 into container slots 30 such that container neck is disposed within the annular opening defined by the handle assembly top portion. Handle assembly 40 is further retained once retaining member 24 is affixed.

Figure 4:
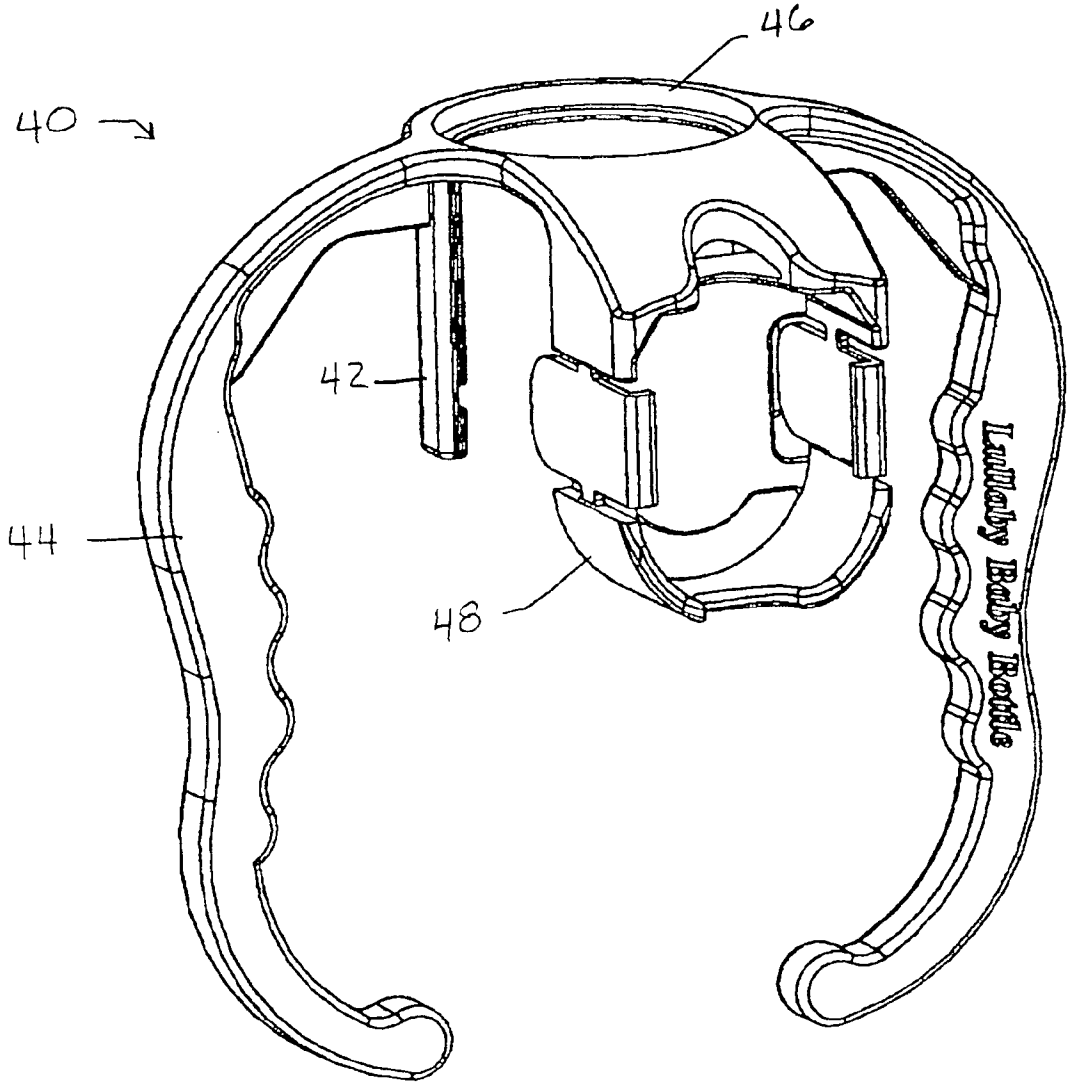
FIG. 4 is a perspective view of the attachable handle.
Figure 5:
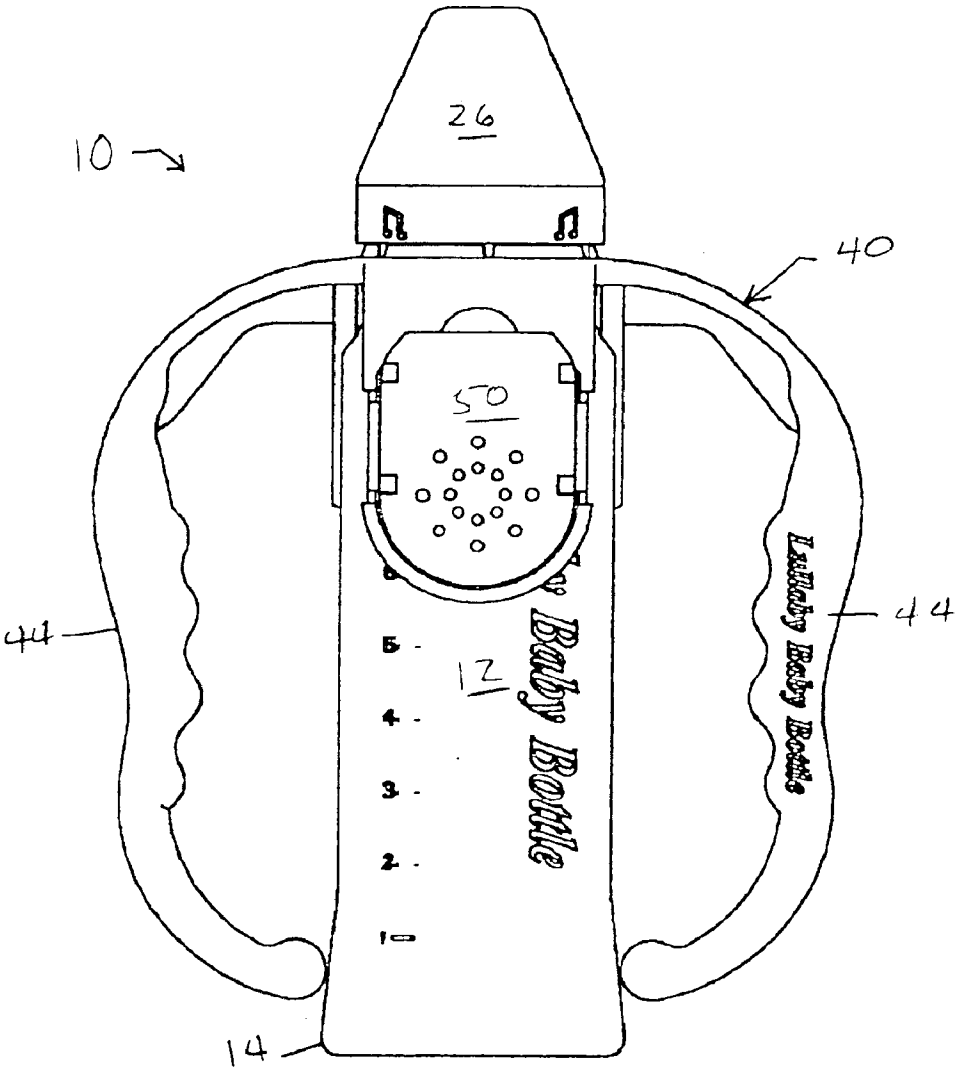
FIG. 5 is a side view of the sound generating baby bottle.
Figure 6:
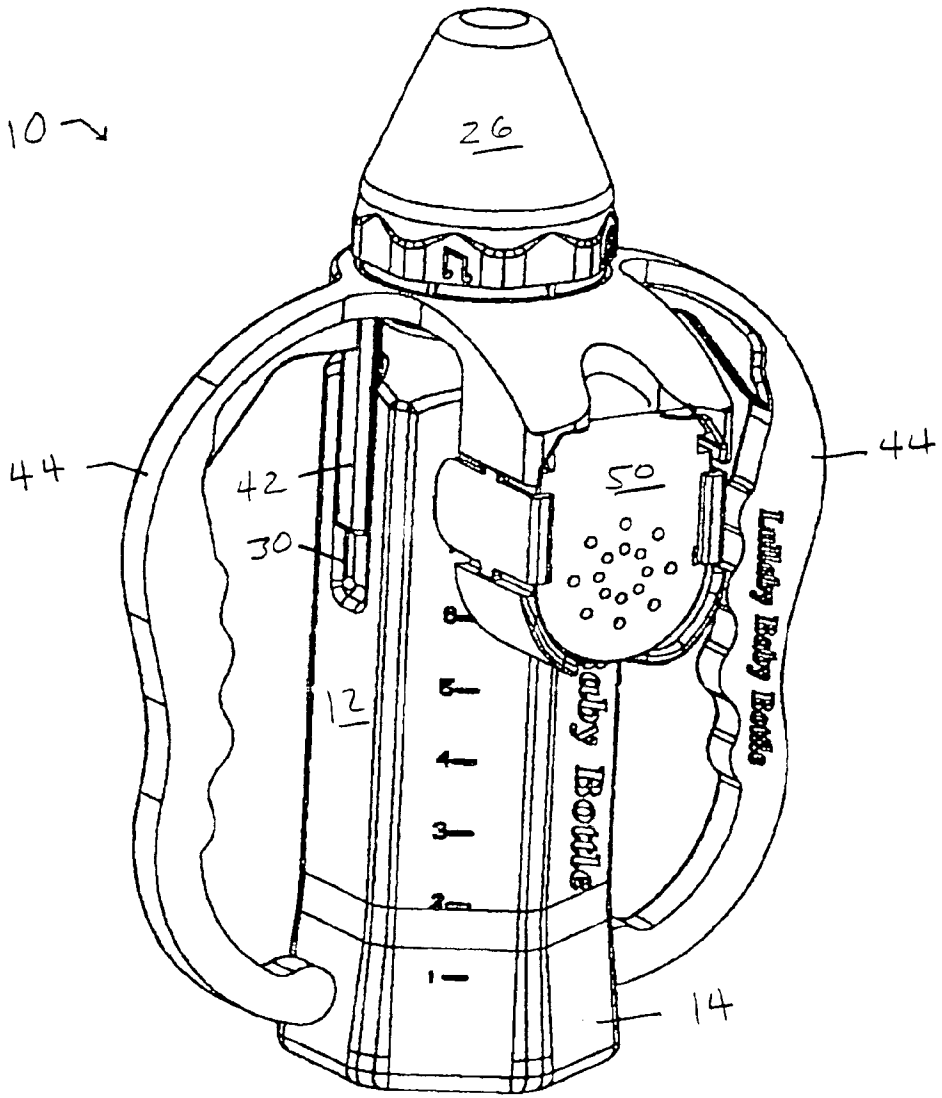
FIG. 6 is a perspective view thereof.
Figure 7:
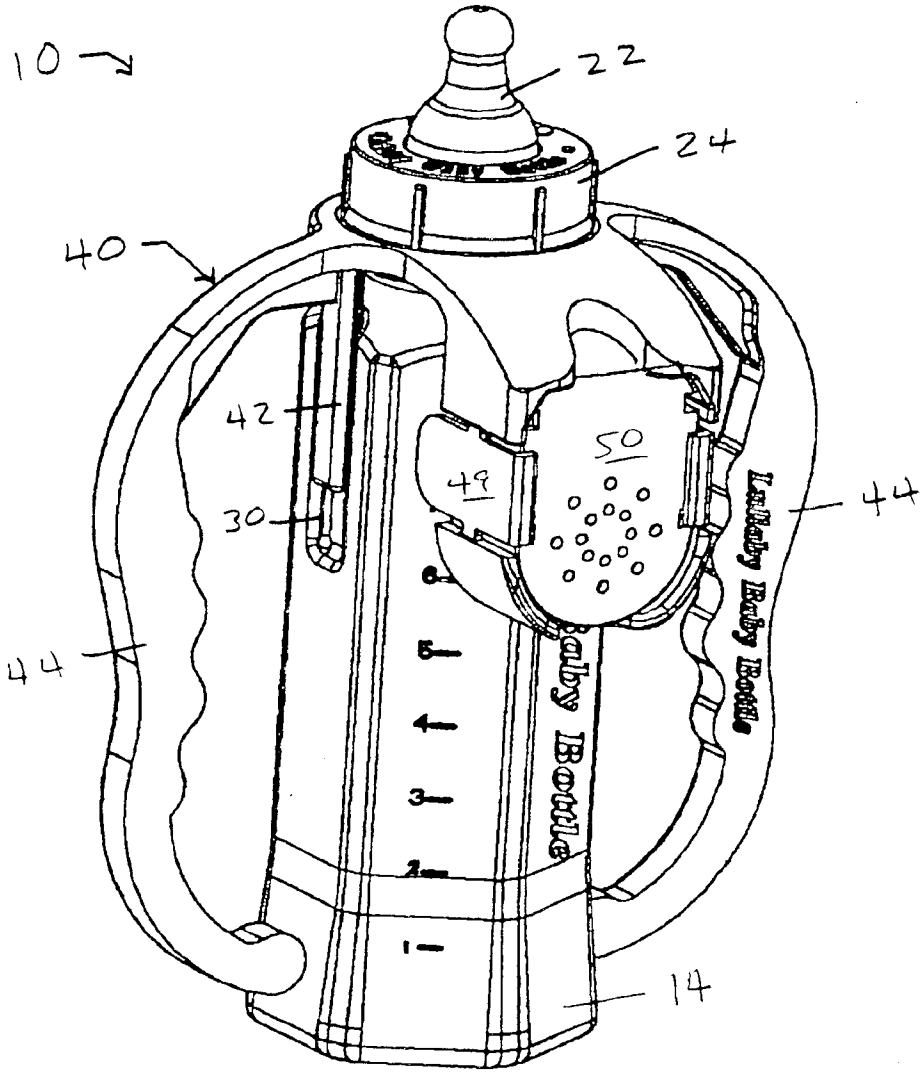
FIG. 7 is another perspective view thereof with cap removed.
Figure 8:
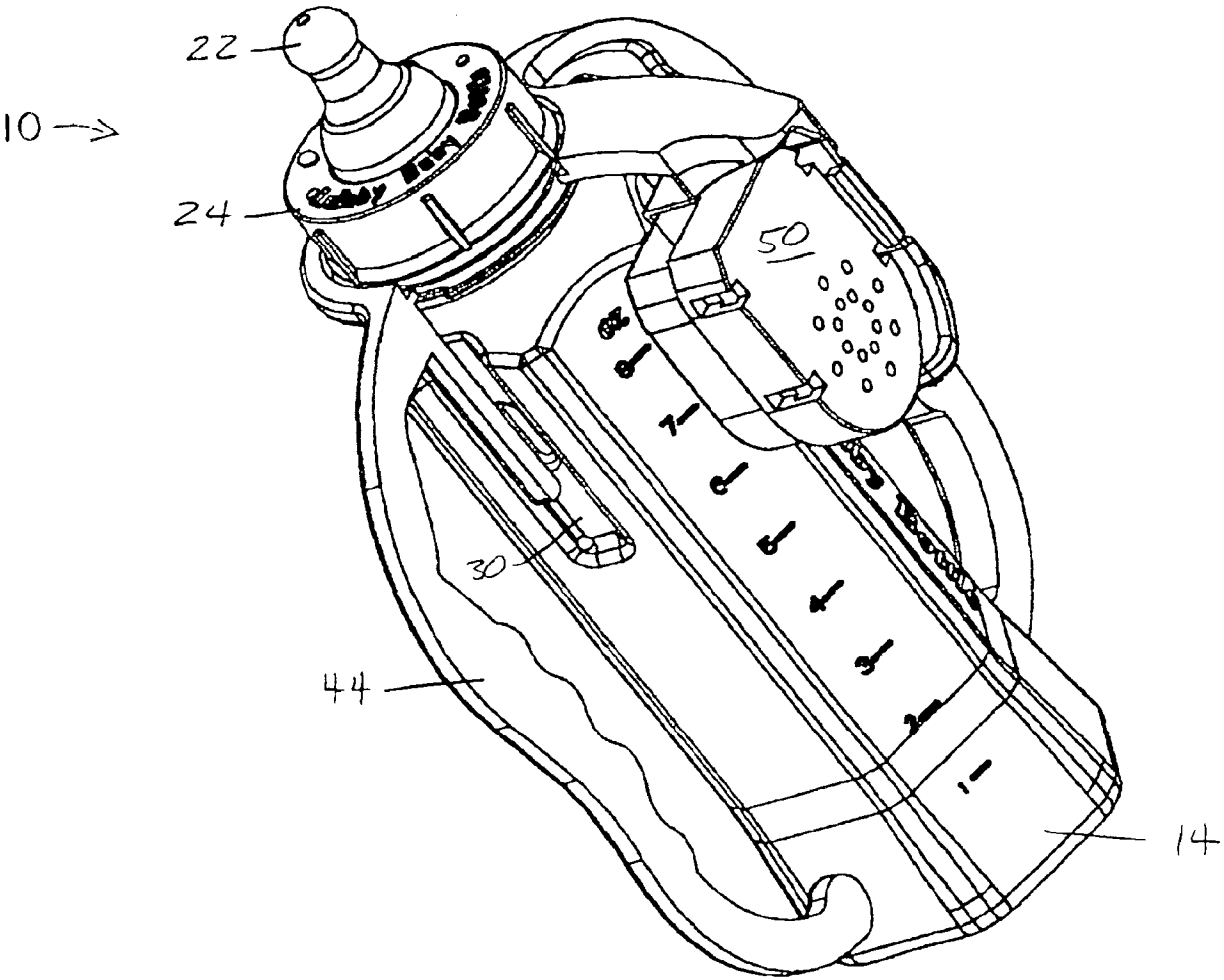
FIG. 8 is a perspective view with the handle assembly depicted in partial section.
Figure 9:
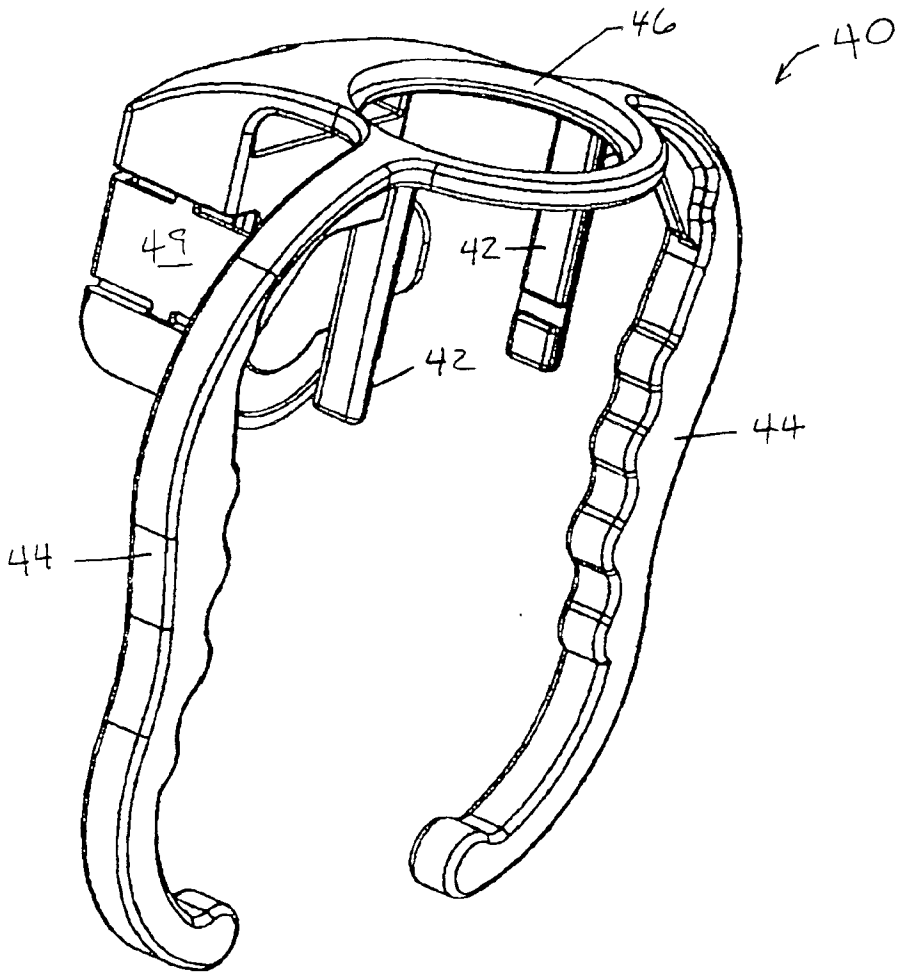
FIG. 9 is a perspective view of the handle assembly.
Figure 10:
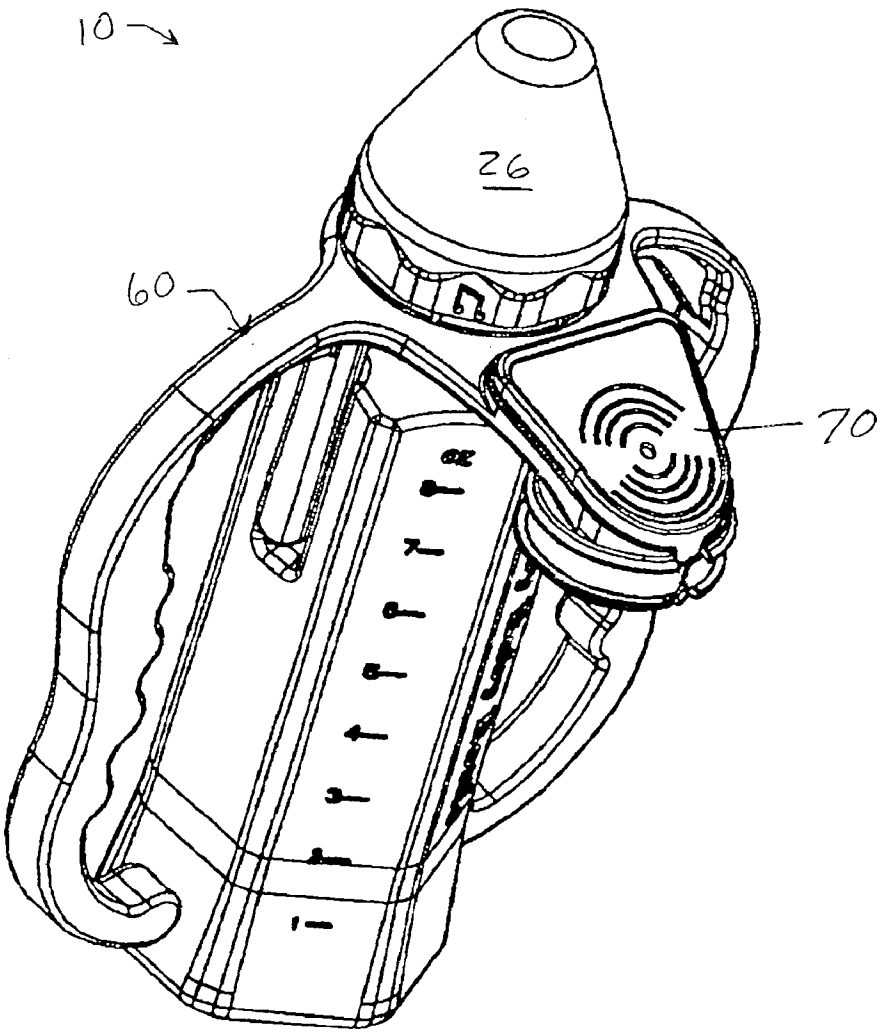
FIG. 10 is a view of an alternate embodiment handle assembly and sound generating module.
Figure 11:
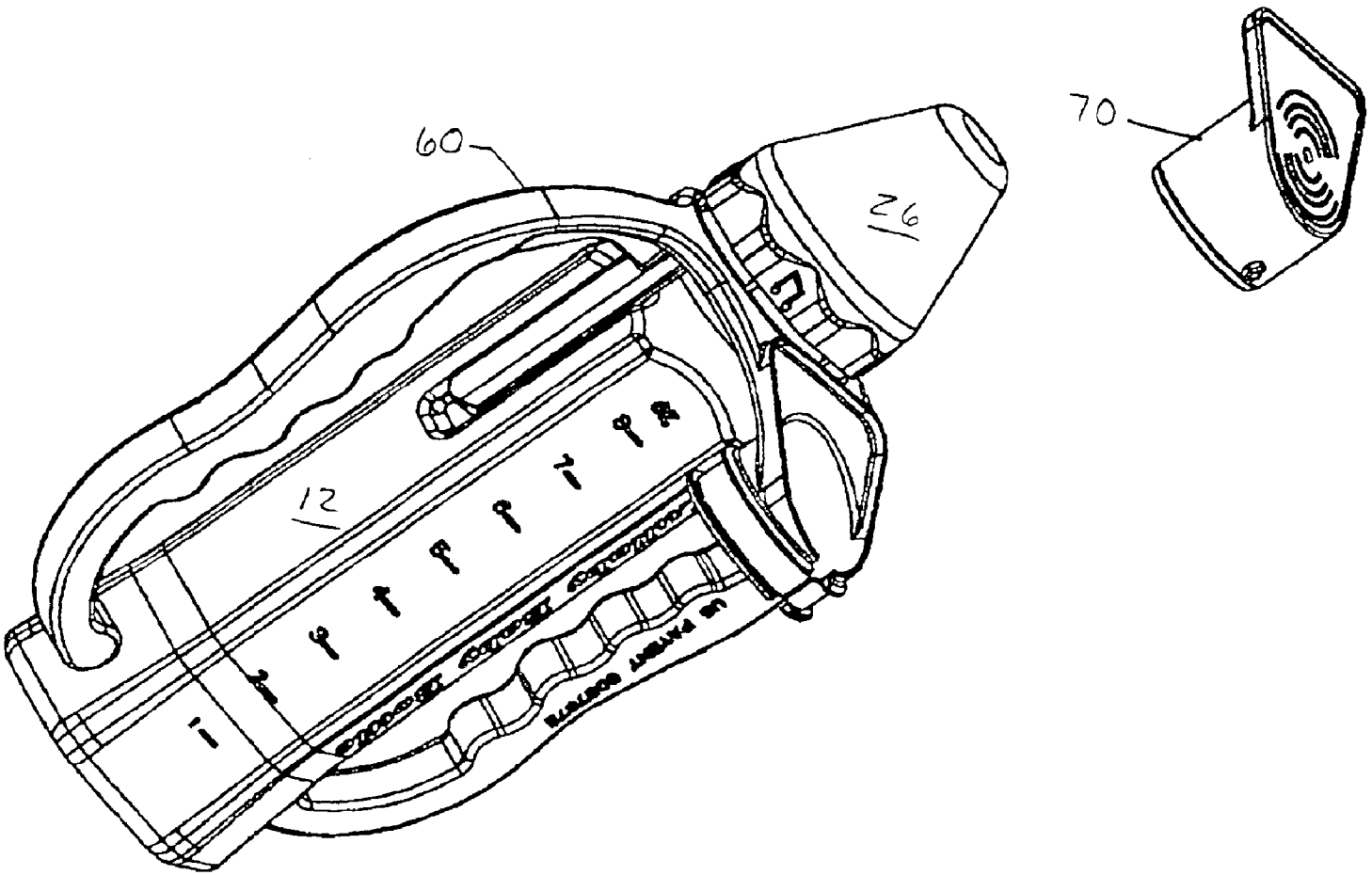
FIG. 11 is a perspective view thereof with the sound generating module removed.
Figure 12:
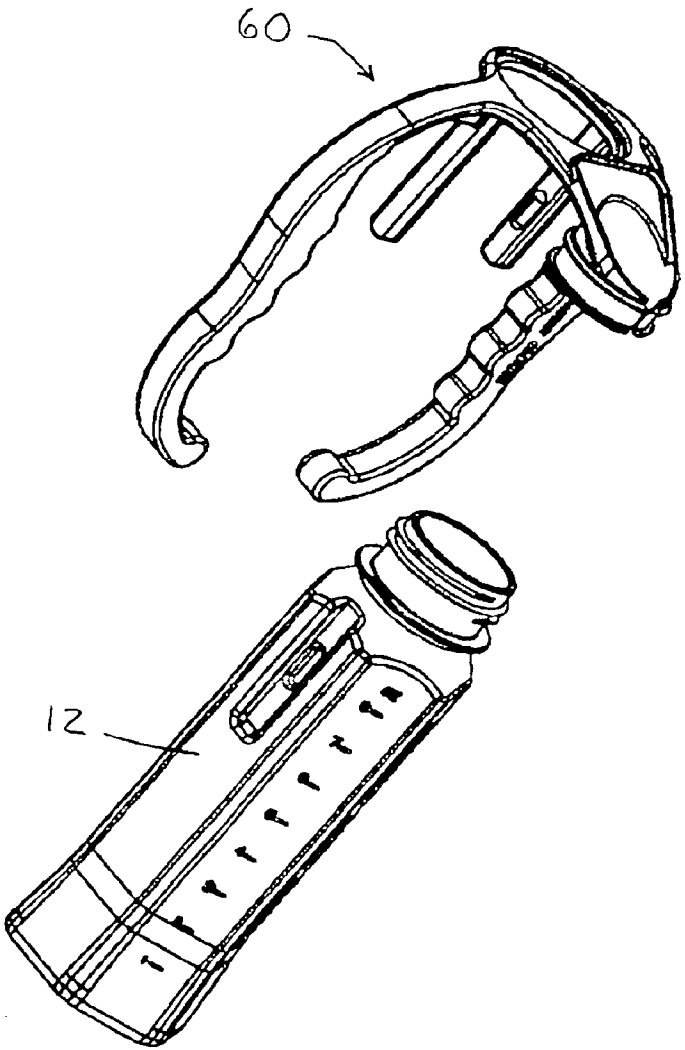
FIG. 12 is a perspective view thereof with the handle assembly removed.
Figure 13:
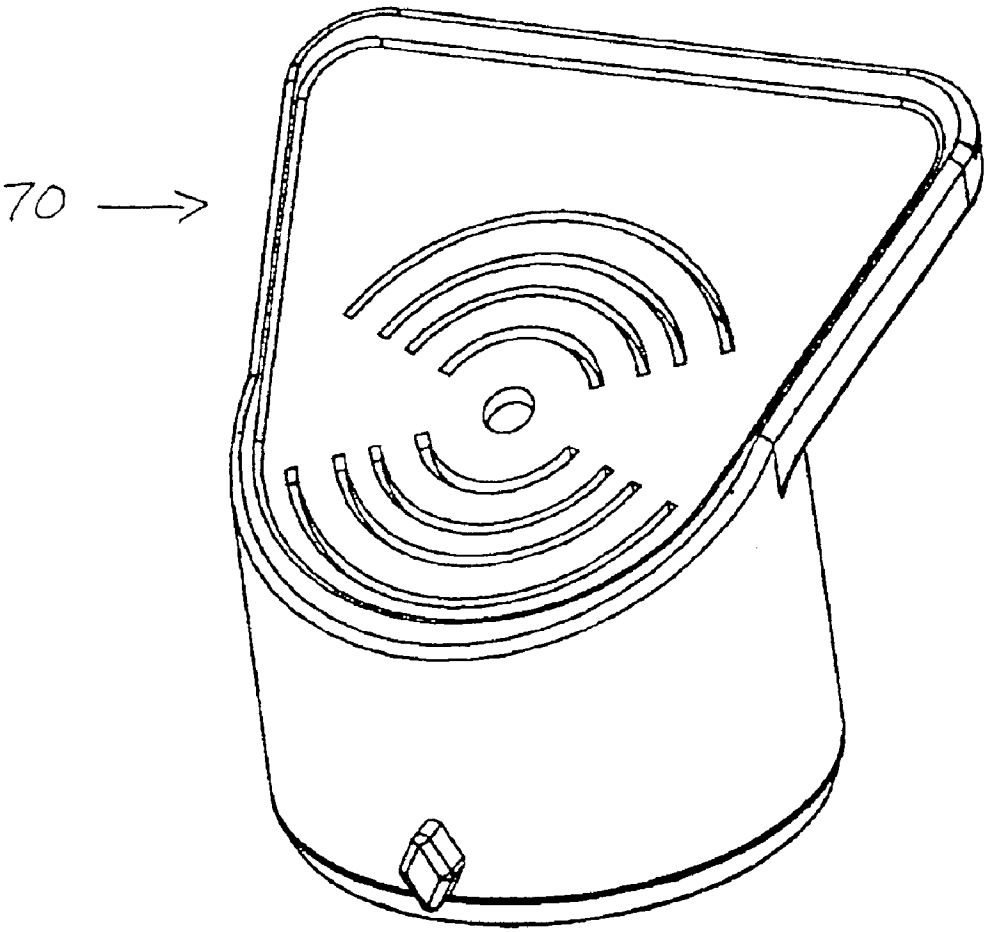
FIGS. 13 and 14 are perspective views of a sound generating module.
Figure 14:
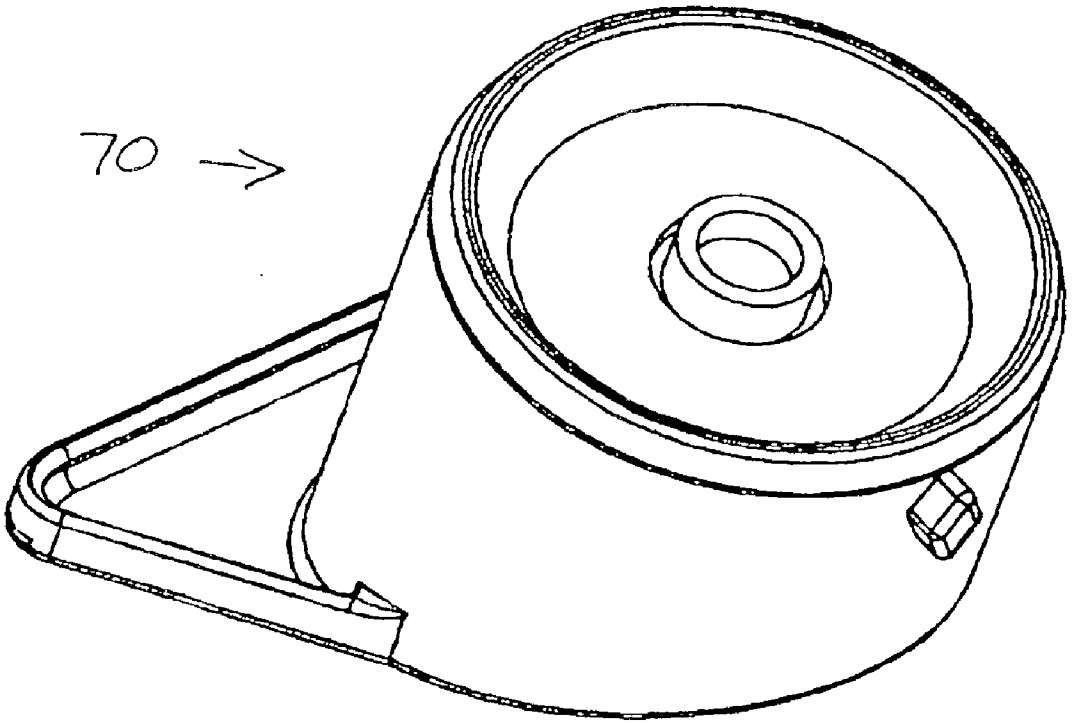

As best depicted in FIGS. 1, 4, and 6, handle assembly 40 is further adapted for receiving a sound-generating module 50 in removable engagement therewith. As best depicted in FIG. 1, handle assembly 40 includes a portion thereof, referenced 48, comprising a compartment for receiving and securing a sound module therein. In a preferred embodiment, compartment 48 includes opposing latch members including clips 49 having inwardly projecting lips that function to secure a sound module within compartment 48. The sound module may be removed (and replaced) by manually pressing the clip ends so as to spread the clip lips from the normally engaged configuration so as to allow for removal of the sound module from compartment 48.

Sound module 50 comprises a compact housing containing an internal battery power source, memory chip, speaker, and electrical circuitry required to selectively produce sounds when disposed on the handle assembly. Sound module 50 may be adapted to play single or multiple songs such as the ABC song or lullabies, or may be configured for educational purposes such as number counting lessons. The sound modules are interchangeable and the production of multiple sound modules provides the user with a variety of sounds to choose from. The electronic aspects of the sound module are generally known in the art and thus are not shown or described in further detail.

FIGS. 10–14 depict a bottle 12 having an alternate handle assembly and sound module configuration. More particularly, bottle 12 is shown with an alternate handle assembly, referenced as 60, adapted for receiving an alternately shaped sound module 70. In this embodiment, handle assembly 60 is adapted with a compartment 62 shaped for receiving a generally cylindrical portion of sound module 70. In all other respects, the handle 60 and sound module 70 are structurally and functionally similar to the handle and sound module disclosed above.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

We claim:

1. A baby bottle comprising:

a hollow, substantially cylindrical container having an exterior surface, a closed end and an opposing open end;

a nipple extending from said container open end and secured by a retaining member connected to said open end;

a handle assembly removably connected to said container, said handle assembly including opposing left and right handles each extending substantially between said container open and closed ends;

said handle including a module-receiving compartment adapted for removably receiving a sound module, said module-receiving compartment including clip means for securing the sound module within said compartment; and an electronic sound module removably attached to said module-receiving compartment, said sound module including means for generating audible sounds.

2. A baby bottle according to claim 1, wherein said container closed end is radially enlarged relative the remaining container body.

3. A baby bottle according to claim 1, wherein said sound module is adapted to play music.

4. A baby bottle according to claim 1, wherein said sound module is adapted to play audible educational material.

5. A baby bottle comprising:

a hollow, substantially cylindrical container having an exterior surface, a closed end and an opposing open end;

said closed end defining a radially enlarged base;

a nipple extending from said container open end and secured by a retaining member connected to said open end;

a handle assembly removably connected to said container, said handle assembly including opposing left side and right side handles each extending substantially between said container open and closed ends, said left and right handles each including a radially inner surface defining a sine-wave pattern;

said handle assembly including means for removably attaching a sound module thereto;

a sound module removably attached to said handle assembly, said sound module including means for generating audible sounds.

6. A baby bottle according to claim 5, wherein said means for removably attaching a sound module includes a compartment adapted with opposing latch members for engaging a sound module, said latch members biased to a first portion wherein said sound module is secured and movable to a second position wherein said sound module is unsecured.

7. A baby bottle according to claim 5, wherein said means for generating audible sounds includes an internal battery power source, memory chip, speaker, and electrical circuitry for selectively produce sounds.

* * * * *